US006695142B2

(12) United States Patent
Chen et al.

(10) Patent No.: US 6,695,142 B2
(45) Date of Patent: Feb. 24, 2004

(54) TOOL STORAGE UNIT CAPABLE OF FIRM RETENTION OF A SOCKET

(75) Inventors: Derek Chen, Taichung Hsien (TW); Steve Huang, Taichung Hsien (TW); Wesley Lee, Taichung Hsien (TW)

(73) Assignee: Stanley Chiro International, Ltd., Taichung Hsien (TW)

( * ) Notice: Subject to any disclaimer, the term of this patent is extended or adjusted under 35 U.S.C. 154(b) by 13 days.

(21) Appl. No.: 10/138,686

(22) Filed: May 3, 2002

(65) Prior Publication Data

US 2003/0205493 A1 Nov. 6, 2003

(51) Int. Cl.[7] ..... B65D 85/02; B65D 85/20

(52) U.S. Cl. ..... 206/378; 206/493; 211/70.6

(58) Field of Search ..... 206/372, 373, 206/376, 378, 443, 493; 211/69.5, 70.6; 220/735; 81/DIG. 1

(56) References Cited

U.S. PATENT DOCUMENTS 4,621,738 A * 11/1986 DeLucchi ..... 211/70.6
6,032,797 A * 3/2000 Kao ..... 206/378
6,109,437 A * 8/2000 Chao ..... 206/378
6,454,092 B1 * 9/2002 Lee ..... 206/378
6,494,329 B1 * 12/2002 Dembicks ..... 211/70.6

* cited by examiner

*Primary Examiner*—David T. Fidei
(74) *Attorney, Agent, or Firm*—Akin Gump Strauss Hauer & Feld, L.L.P.

(57) ABSTRACT

A tool storage unit includes left and right walls, and a bottom wall. A left protrusion projects from an upper segment of the left wall toward the right wall for urging a front end wall of a socket. A right protrusion projects from an intermediate segment of the right wall toward the left wall for abutting against a central depressed area in a rear end wall of the socket. A plurality of the tool storage units are interconnected in a row for storing a plurality of sockets, in which the left protrusions on the left walls of the tool storage units are formed as a continuous projection that extends across the left walls.

4 Claims, 16 Drawing Sheets

TOOL STORAGE UNIT CAPABLE OF FIRM RETENTION OF A SOCKET

FIELD OF THE INVENTION

The invention relates to a tool box, more particularly to a tool storage unit which can firmly secure a socket therein.

DESCRIPTION OF THE RELATED ART

With reference to FIGS. 1 and 2, a conventional socket storing device of a tool box includes a plurality of partition members 2. Each adjacent pair of the partition members 2 confines a groove 1 therebetween for retaining a socket 4 therein. The partition members 2 include protrusions 3 that project toward each other such that, when the socket 4 is fitted into the groove 1, the protrusions 3 can frictionally engage the outer wall surface of the socket 4 to thereby position the socket 4 firmly in the groove 1. However, the arrangement of the partition members 2 with the protrusions 3 requires a relatively large amount of space.

In order to eliminate the aforesaid drawback, another socket storing structure, such as that shown in FIGS. 3 and 4, has been proposed for use in a tool box. In this structure, two oppositely spaced apart left and right walls and a plurality of partition plates cooperatively define a row of grooves 5. Retaining protrusions 6, 7 are respectively provided on the left and right walls that confine a respective one of the grooves 5 for retaining a socket 8. The retaining protrusions 6, 7 are configured to retain opposite ends of a socket hole-defining wall 801 of the socket 8. As the retaining protrusions 6, 7 are provided on the left and right walls, they do not occupy a large amount of the space inside the tool box. However, as contact between the retaining protrusions 6, 7 and each of the sockets 8 are at two points only, the positioning effect is not satisfactory. Besides, the retaining protrusions 6, 7 have to be individually provided on the left and right walls, which complicates the manufacturing process.

SUMMARY OF THE INVENTION

Therefore, the main object of the present invention is to provide a tool storage unit for removably and firmly securing a socket therein.

Accordingly, a tool storage unit is adapted for removably and firmly securing a socket which includes front and rear end walls opposite to each other along an axis and respectively having front and rear peripheries, and a tubular wall which extends along the axis to interconnect the front and rear peripheries. The socket has a first length along the axis. The front end wall has a socket recess extending inwardly and along the axis for engaging a nut. The rear end wall has a central depressed area which extends toward the front end wall and which extends inwardly and radially from a circumferential line that is disposed inwardly and radially of the rear periphery. The central depressed area has an insert hole which extends toward the front end wall, which is configured to engage a drive head of a socket wrench, and which borders the central depressed area by an inner peripheral line. The central depressed area defines a lower limit line that is the shortest one of chords of the circumferential line, and that intersects only two points of the inner peripheral line. The tool storage unit includes:

a bottom wall having left and right ends opposite to each other in a longitudinal direction, the left and right ends defining in the longitudinal direction a second length which is longer than the first length;

left and right walls which extend from the left and right ends respectively in an upright direction, each of the left and right walls including lower and upper segments proximate to and distal from the bottom wall, and a middle segment interposed therebetween, the socket being placed in the tool storage unit in a stored position, where the tubular wall has a lower part close to the bottom wall, the rear end wall confronts the right wall, and the axis is oriented in the longitudinal direction;

a right protrusion which protrudes from the middle segment of the right wall toward the left wall, which extends in a transverse direction that is transverse to both the longitudinal direction and the upright direction, and which has a third length along the transverse direction that is not shorter than the lower limit line; and a left protrusion which projects from the upper segment of the left wall toward the right wall and which extends in the transverse direction such that, when the socket is placed in the tool storage unit in the stored position, the left protrusion abuts against two points on the front periphery of the front end wall and the right protrusion abuts against the central depressed area.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENT

Figure 1:
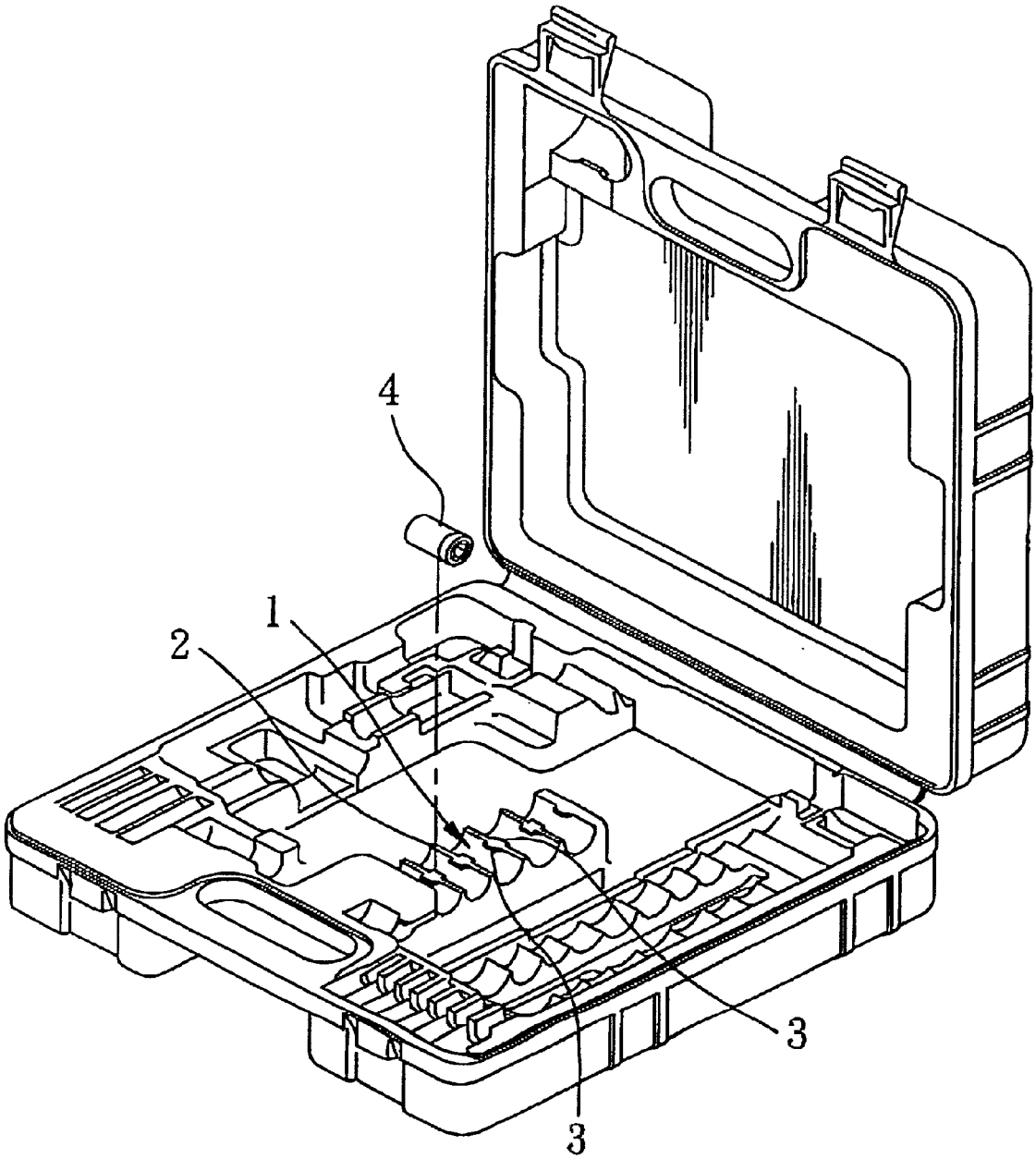
FIG. 1 PRIOR ART
FIG. 1 is a perspective view of a tool box with a conventional socket storing device.
Figure 2:
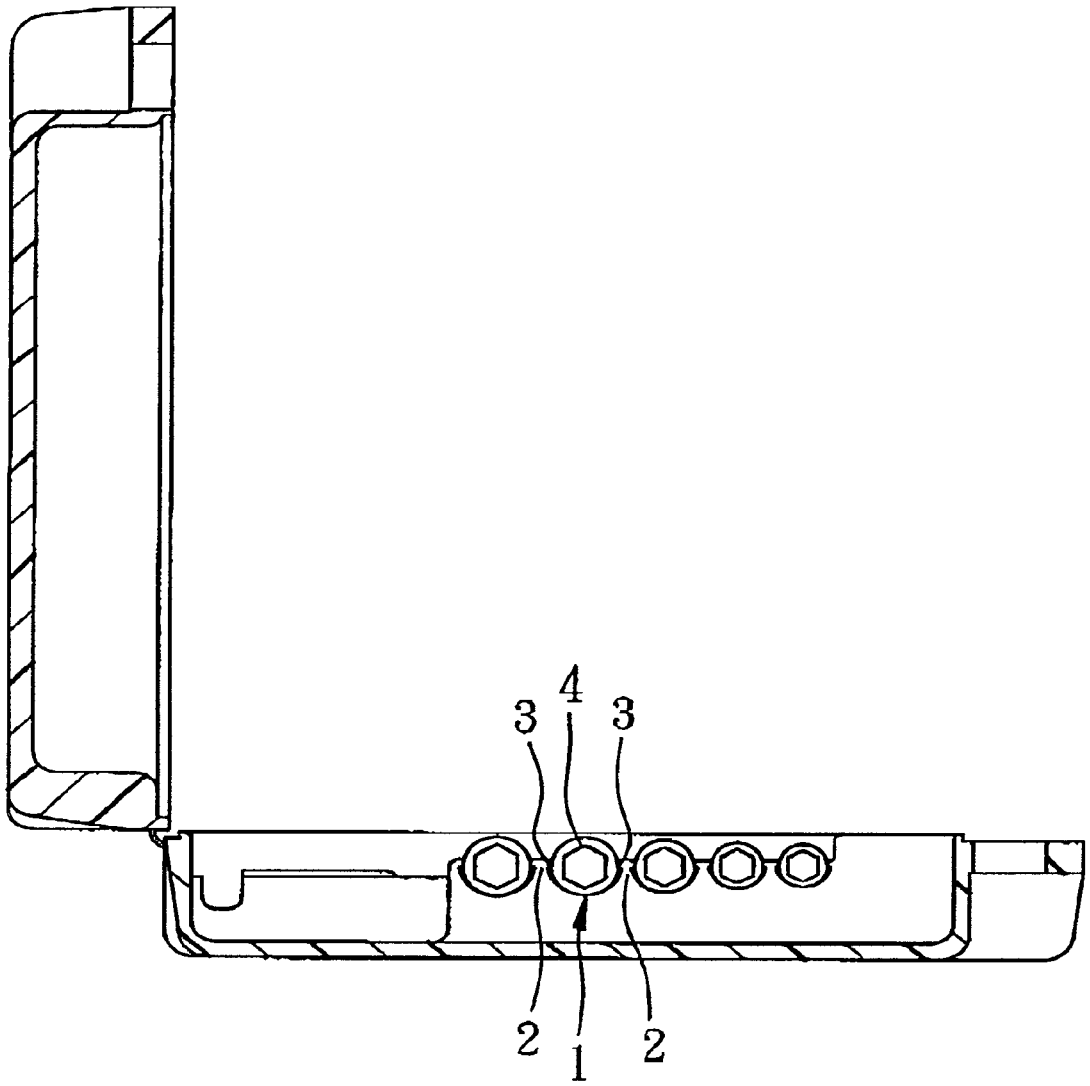
FIG. 2 PRIOR ART
FIG. 2 is a schematic side view of the tool box of FIG. 1 with sockets stored therein.
Figure 3:
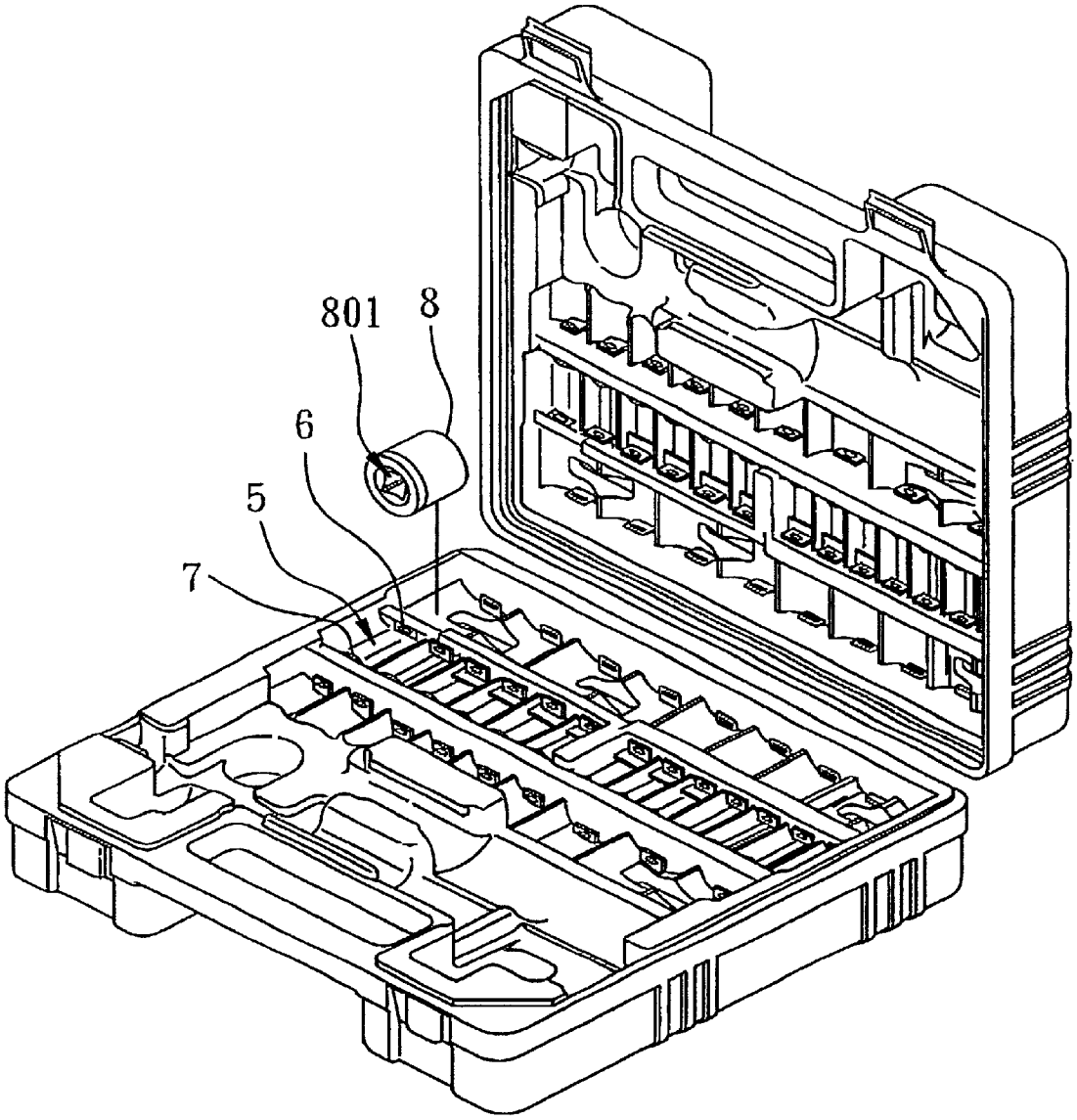
FIG. 3 PRIOR ART
FIG. 3 is a perspective view of a tool box with another conventional socket storing structure.
Figure 4:
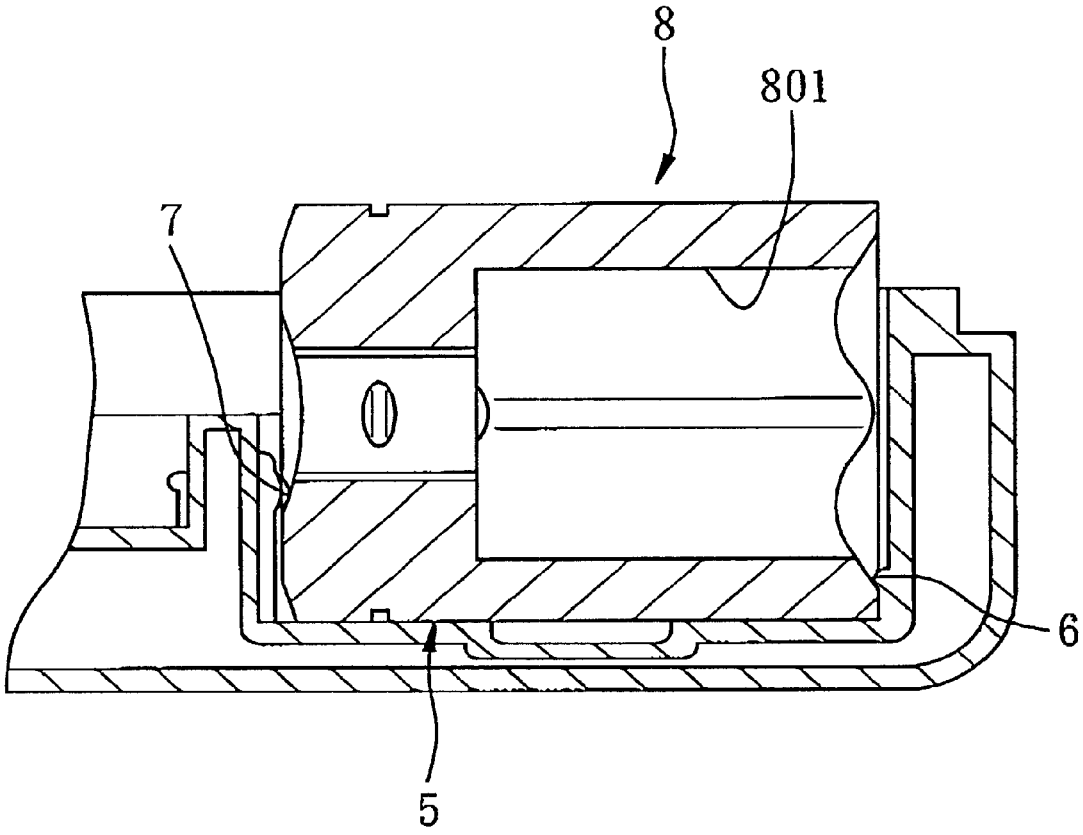
FIG. 4 PRIOR ART
FIG. 4 is a fragmentary schematic sectional view showing the conventional socket storing structure of FIG. 3 in a state of use.

Before the present invention is described in greater detail, it should be noted that like elements are denoted by the same reference numerals throughout the disclosure.

Figure 5:
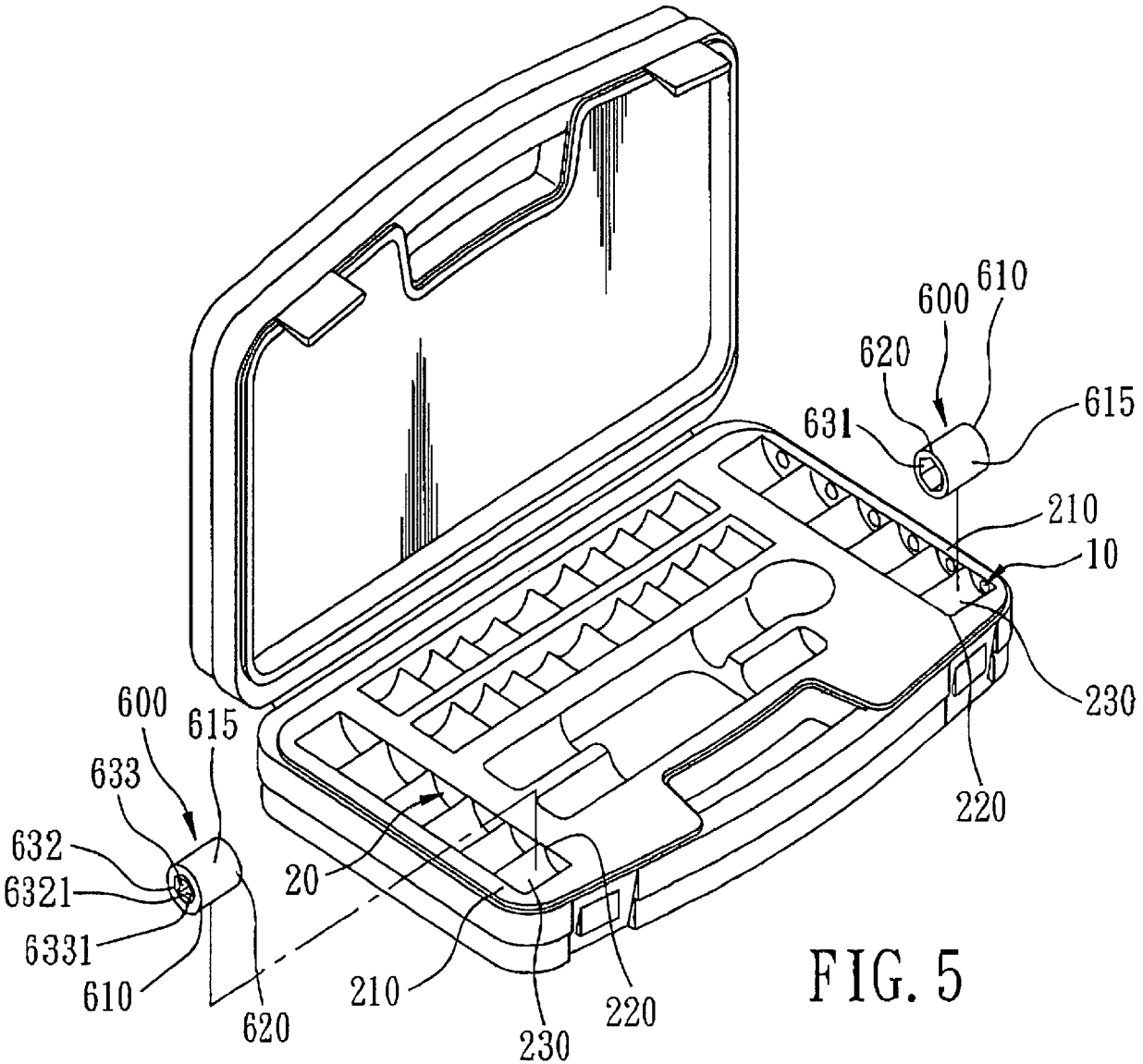
FIG. 5 is a perspective view showing the first preferred embodiment of a tool storage unit according to the invention.
Figure 6:
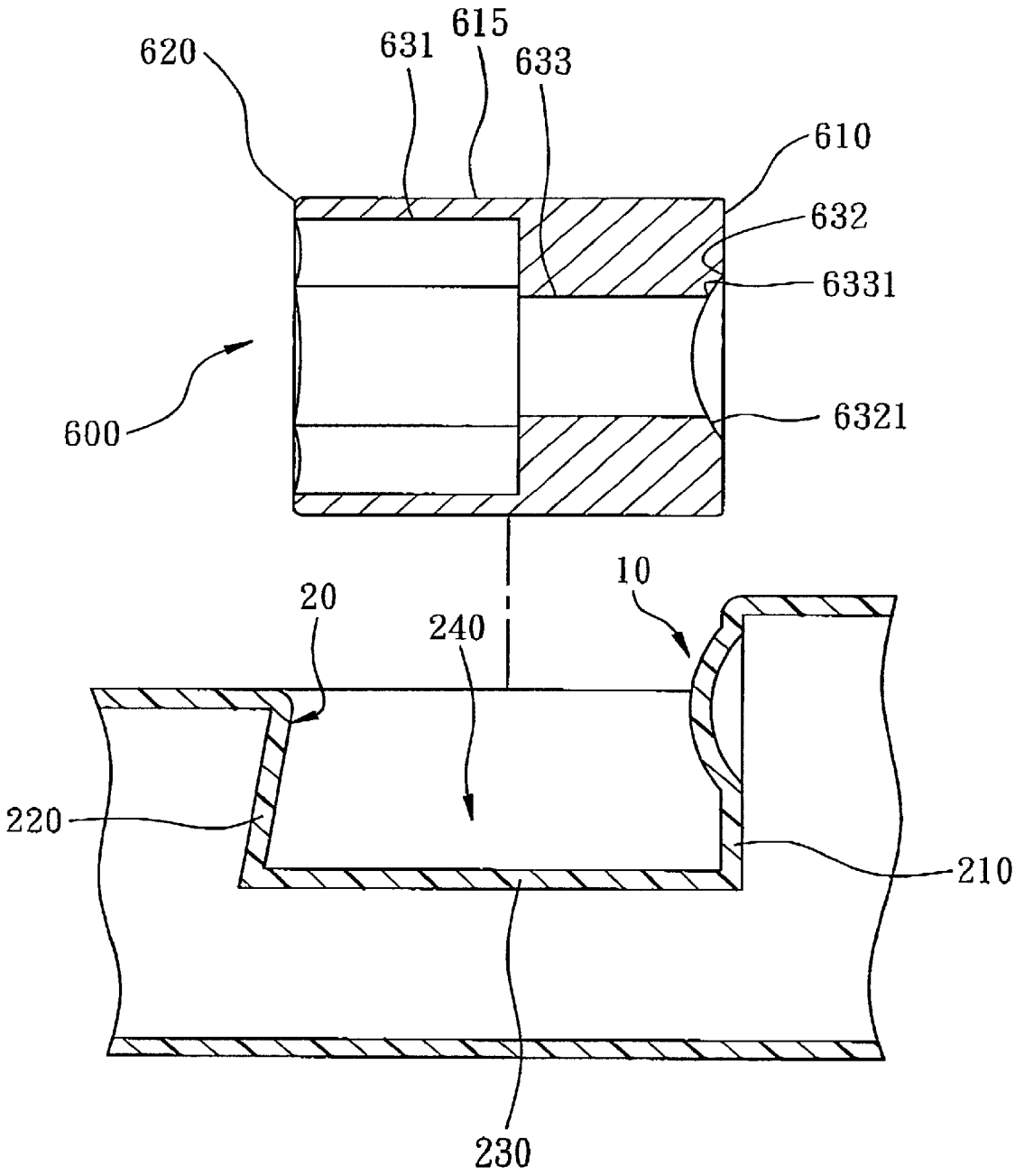
FIG. 6 is a fragmentary schematic sectional view of the first preferred embodiment prior to placement of a socket therein.

Referring to FIGS. 5 and 6, the preferred embodiment of a tool storage unit according to the present invention is shown to be adapted for removably and firmly securing a socket 600 therein. Typically, the socket 600 includes front and rear end walls 620, 610 which are opposite to each other along an axis, and which respectively have front and rear peripheries, and a tubular wall 615 which extends along the axis to interconnect the front and rear peripheries and which has front and rear portions. The socket 600 has a first length along the axis. The front end wall 620 has a socket recess 631 extending inwardly and along the axis for receiving a nut (not shown) in a spline engagement. The rear end wall 610 has a central depressed area 6321 which extends toward the front end wall 620 and which extends inwardly and radially from a circumferential line 632 that is disposed inwardly and radially of the rear periphery. The central depressed area 6321 has an insert hole 633 which extends toward the front end wall 620 and which is configured to receive a drive head (not shown) of a socket wrench (not shown) in a spline engagement. In this embodiment, the insert hole 633 is a square hole defined by a peripheral wall, and borders the central depressed area 6321 by an inner peripheral line 6331. The central depressed area 6321 defines a lower limit line (L) (see FIG. 14) that is the shortest one of the chords of the circumferential line 632, and that intersects only two points of the inner peripheral line 6331.

As shown, the tool storage unit includes a bottom wall 230, left and right walls 220, 210, a right protrusion 10, and a left protrusion 20. The bottom wall 230 cooperates with the left and right walls 220, 210 to define a socket-storing space 240, and has left and right ends opposite to each other in a longitudinal direction. The left and right ends define in the longitudinal direction a second length that is longer than the first length. The left and right walls 220, 210 extend from the left and right ends respectively in an upright direction. Each of the left and right walls 220, 210 includes lower and upper segments proximate to and distal from the bottom wall 230, and a middle segment interposed therebetween. The socket 600 is placed in the tool storage unit in a stored position (i.e., the socket 600 is disposed in the socket-storing space 240), where the tubular wall 615 has a lower part close to the bottom wall 230, the rear end wall 610 confronts the right wall 210, and the axis is oriented in the longitudinal direction. The right protrusion 10 protrudes from the middle segment of the right wall 210 toward the left wall 220, and extends in a transverse direction that is transverse to both the longitudinal direction and the upright direction. The right protrusion 10 has a third length along the transverse direction that is not shorter than the lower limit line (L) (see FIG. 14). The left protrusion 20 projects from the upper segment of the left wall 220 toward the right wall 210, and extends in the transverse direction. When the socket 600 is in the stored position, the left protrusion 20 abuts against two points on the front periphery of the front end wall 620 and the right protrusion 10 abuts against the central depressed area 6321.

Figure 14:
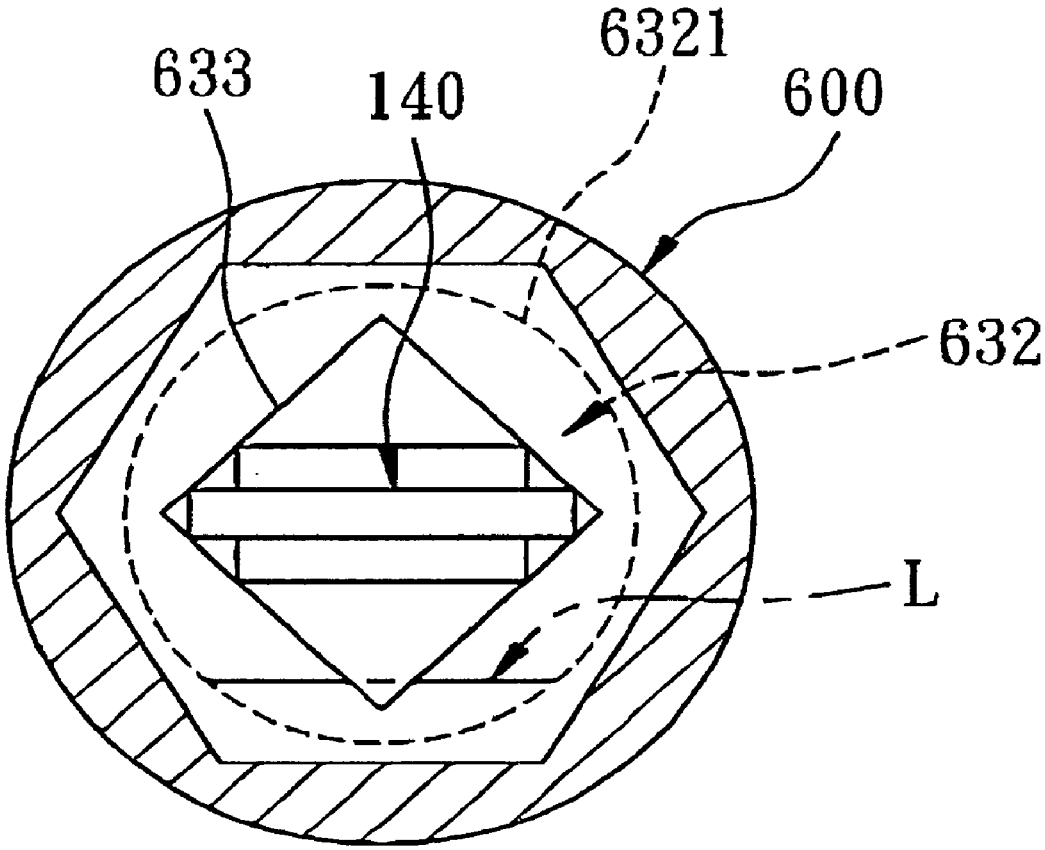
FIG. 14 is a schematic sectional view illustrating a right protrusion abutting against two diagonally opposite ends of an insert hole in the socket.

In this embodiment, the right protrusion 10 is in the form of a dome-shaped boss having a diameter, i.e., the third length, corresponding to the diameter of the circumferential line 632 such that, when the socket 600 is disposed in the socket-storing space 240, the right protrusion 10 abuts against the central depressed area 6321 above the lower limit line (L) (see FIG. 14). The left wall 220 inclines gradually toward the right wall 210, and the left protrusion 20 has an inclined plane oriented toward the right wall 210. When the socket 600 is in the stored position, the left protrusion 20 urges the front periphery of the front end wall 620 to urge the central depressed area 6321 toward the right protrusion 10.

Figure 7:
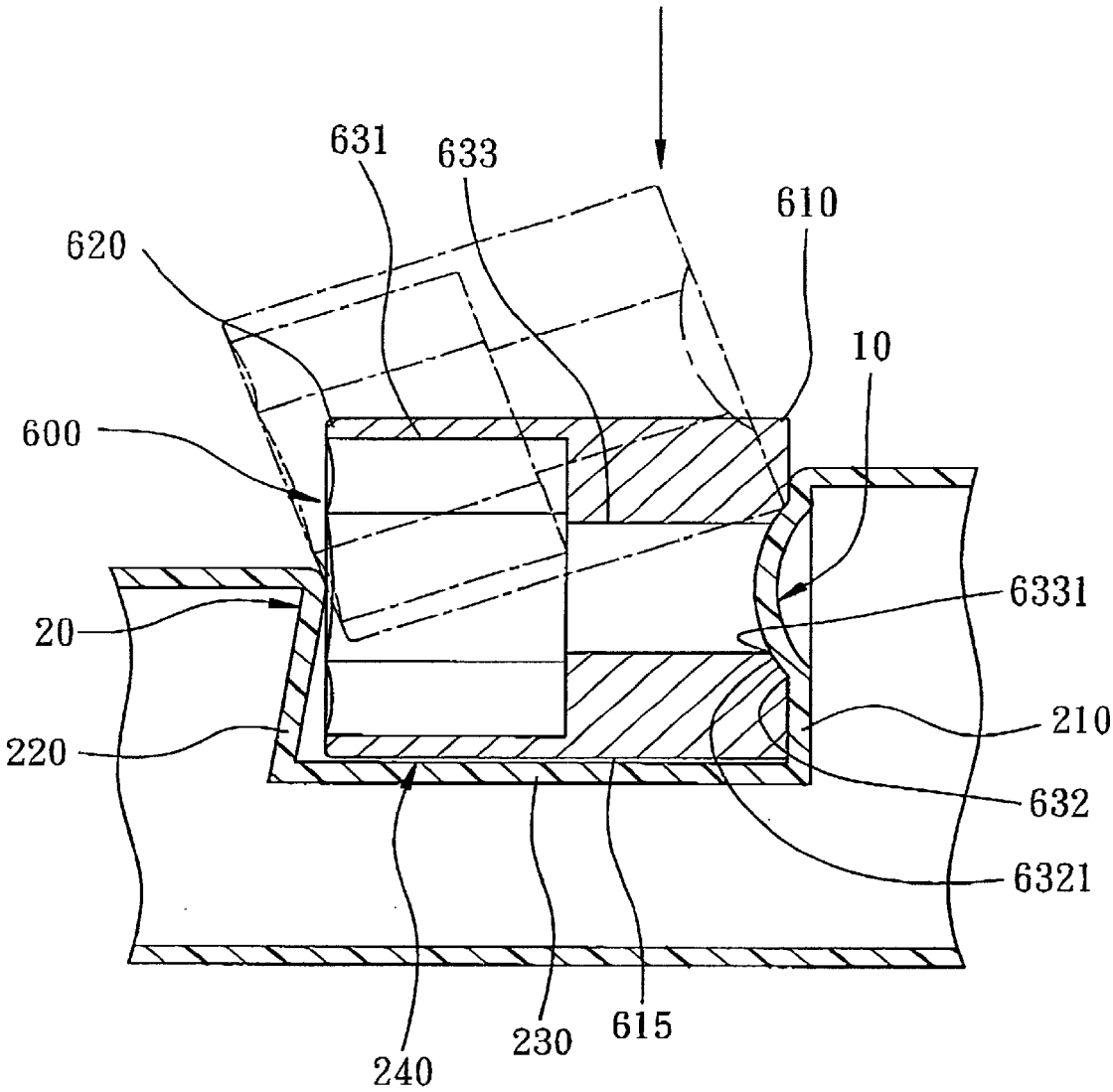
FIG. 7 is a fragmentary schematic sectional view of the first preferred embodiment illustrating how the socket is disposed in a stored position.

In use, referring to FIG. 7, when the socket 600 is to be disposed in the socket-storing space 240, the front end wall 620 of the socket 600 is brought to abut against the left protrusion 20 slightly, and the rear portion of the tubular wall 615 is pressed downwardly into the socket-storing space 240. At this point, the left protrusion 20 will urge the front end wall 620 of the socket 600 so that the central depressed area 6321 is urged toward the right protrusion 10. Hence, the socket 600 can be firmly held in the socket-storing space 240 by virtue of the left and right protrusions 20, 10. On the other hand, when it is desired to remove the socket 600 from the socket-storing space 240, the user can grip the front portion of the tubular wall 615 and exert a force to disengage the front end wall 620 from the left wall 220 to permit removal of the socket 600 from the tool storage unit.

By virtue of the construction of the present invention, the following advantages can be achieved:

1. Since the left and right protrusions 20, 10 are formed on the left and right walls 220, 210 of the tool storage unit, they do not take up much space. Therefore, a relatively large number of tool storage units can be provided for storing a greater number of sockets 600.
2. When the socket 600 is disposed in the socket-storing space 240, the right protrusion 10 abuts against the entire central depressed area 6321, which means that the contact between the right protrusion 10 and the central depressed area 6321 is increased to result in surface contact. On the other hand, the left protrusion 20 urges against the front end wall 620 of the socket 600 at two points along the transverse direction to provide a linear positioning effect. Thus, the present invention provides an enhanced socket positioning effect.
3. When storing a number of sockets 600, the left protrusion 20 can be configured as a continuous projection that extends in the transverse direction across the left walls 220 of the tool storage units. As there is no need to form separate left protrusions 20 on the left walls 220, the manufacturing process can be simplified.

Figure 8:
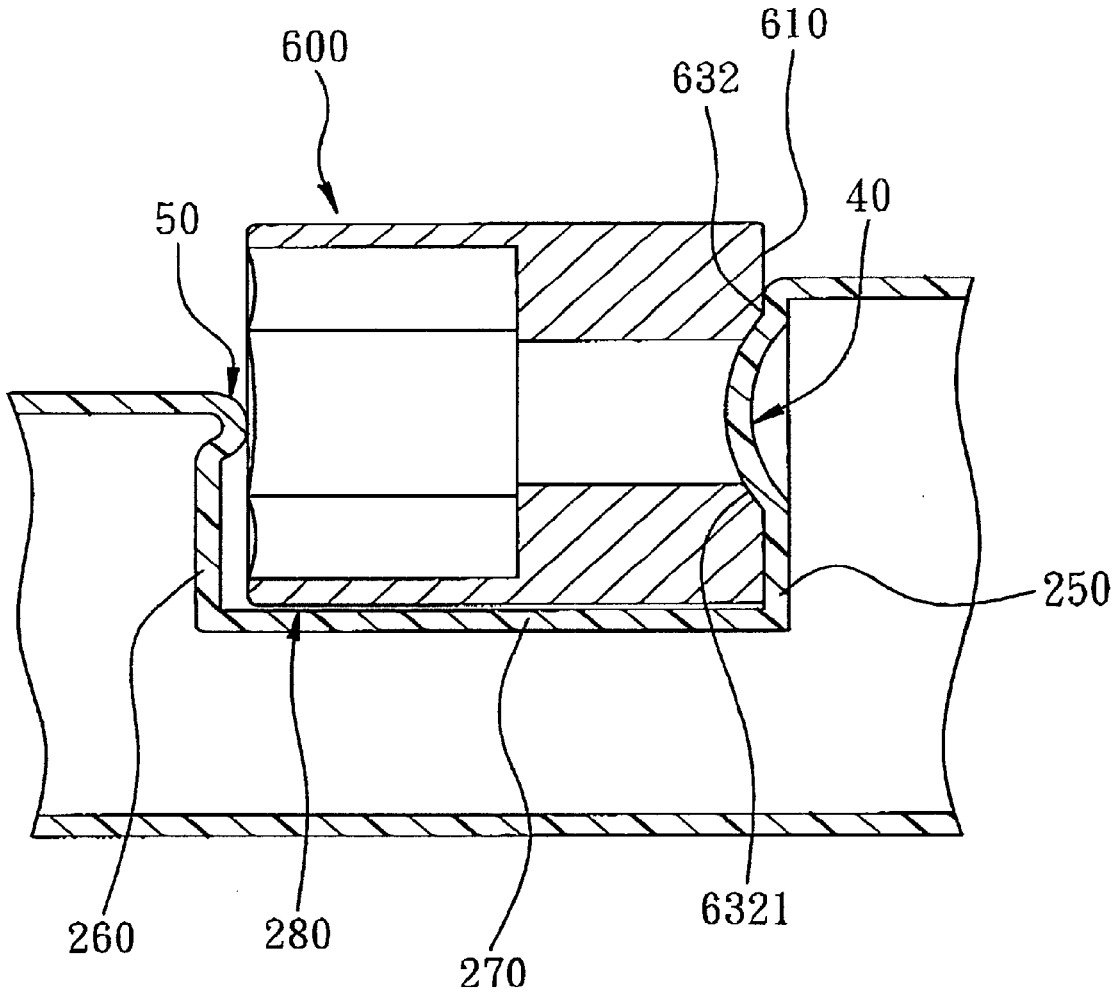
FIG. 8 is a fragmentary schematic sectional view of the second preferred embodiment of a tool storage unit according to the present invention, with the socket disposed in the stored position.

With reference to FIG. 8, the second preferred embodiment of a tool storage unit according to the present invention is shown to include left and right walls 260, 250, a bottom wall 270, and left and right protrusions 50, 40. The left and right walls 260, 250 cooperate with the bottom wall 270 to confine a socket-storing space 280 for receiving the socket 600. As in the first preferred embodiment, the right protrusion 40 in this embodiment is in the form of a dome-shaped boss having a diameter corresponding to the central depressed area 6321 of the rear end wall 610 of the socket 600. This embodiment differs from the first preferred embodiment in that the left protrusion 50 is in the form of a rib protruding from the left wall 260 toward the right wall 250.

Figure 9:
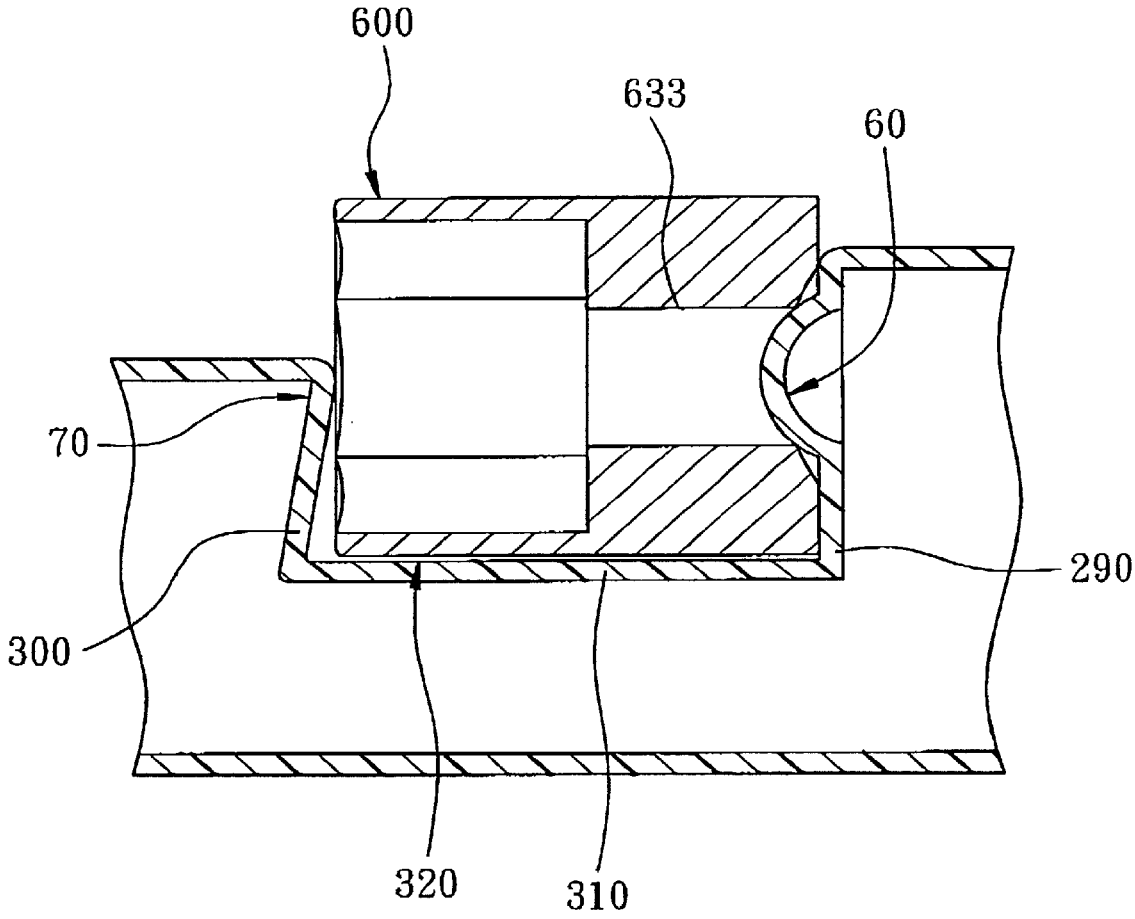
FIG. 9 is a fragmentary schematic sectional view of the third preferred embodiment of a tool storage unit according to the present invention, with the socket disposed in the stored position.

With reference to FIG. 9, the third preferred embodiment of a tool storage unit according to the present invention is shown to include left and right walls 300, 290, a bottom wall 310, and left and right protrusions 70, 60. The left and right walls 300, 290 cooperate with the bottom wall 310 to confine a socket-storing space 320 for receiving the socket 600. In this embodiment, the left protrusion 70 has a configuration identical to that of the left protrusion 20 in the first preferred embodiment. This embodiment differs from the previous embodiments in that the right protrusion 60, which is likewise in the form of a dome-shaped boss as in the previous embodiments, has a diameter corresponding to that of the insert hole 633 such that the right protrusion 60 extends into the insert hole 633.

Figure 10:
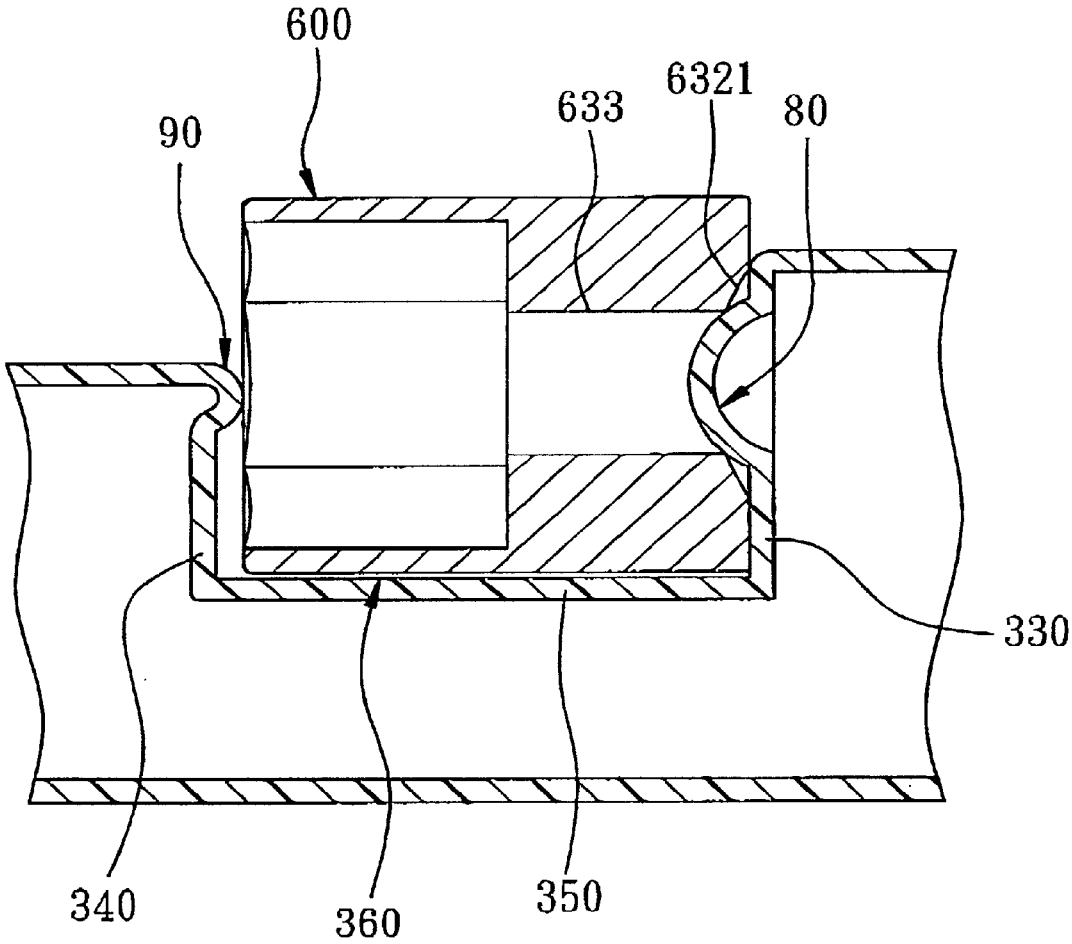
FIG. 10 is a fragmentary schematic sectional view of the fourth preferred embodiment of a tool storage unit according to the present invention, with the socket disposed in the stored position.

With reference to FIG. 10, the fourth preferred embodiment of a tool storage unit according to the present invention is shown to include left and right walls 240, 330, a bottom wall 350, and left and right protrusions 90, 80. The left and right walls 340, 330 cooperate with the bottom wall 350 to confine a socket-storing space 360. In this embodiment, the right protrusion 80 is configured to be identical to the right protrusion 60 in the third preferred embodiment, whereas the left protrusion 90 is configured to be identical to the left protrusion 50 in the second preferred embodiment.

Figure 11:
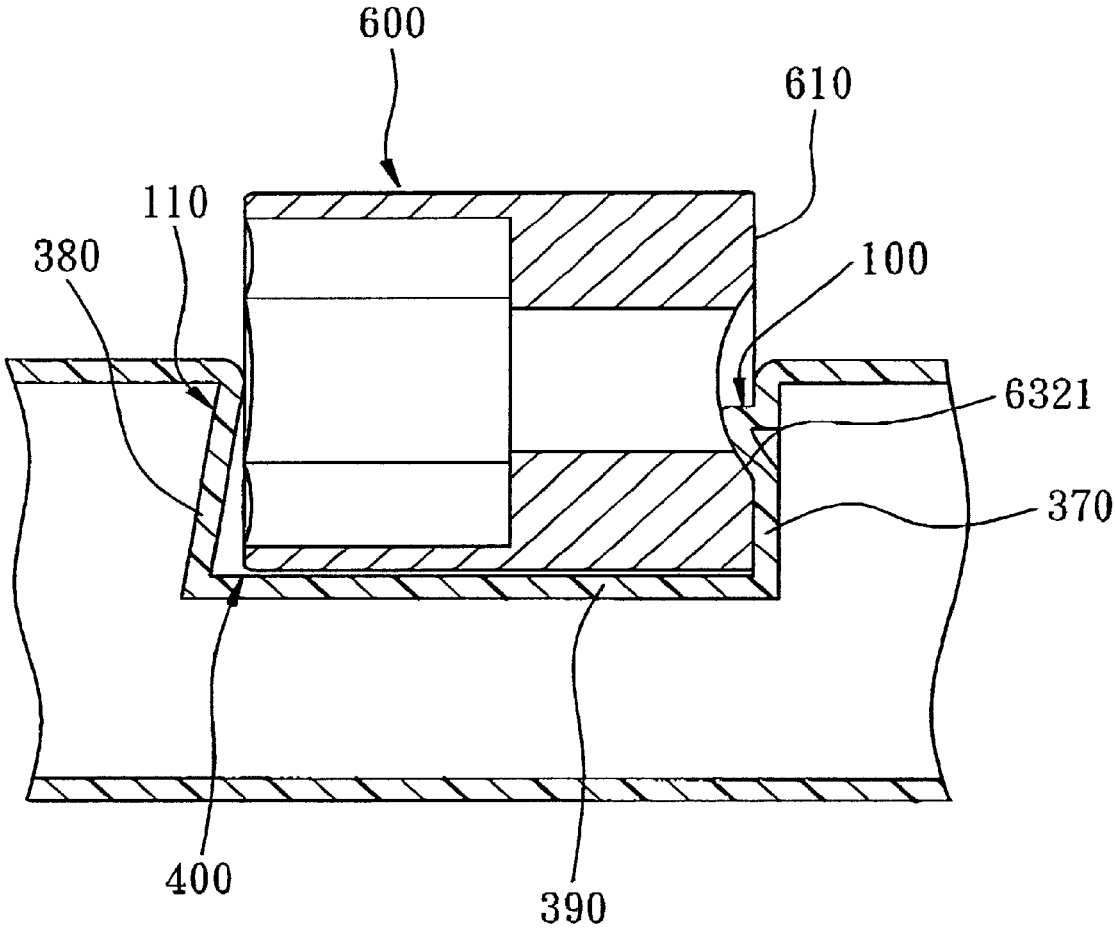
FIG. 11 is a fragmentary schematic sectional view of the fifth preferred embodiment of a tool storage unit according to the present invention, with the socket disposed in the stored position.

With reference to FIG. 11, the fifth preferred embodiment of a tool storage unit according to the present invention is shown to include left and right walls 380, 370, a bottom wall 390, and left and right protrusions 110, 100. The left and right walls 380, 370 cooperate with the bottom wall 390 to confine a socket-storing space 400. The left protrusion 380 has a configuration identical to those of the left protrusions 20, 70 in the first and third preferred embodiments. This embodiment differs from the previous embodiments in that the right protrusion 100 is in the form of a semi dome-shaped boss that abuts against a lower part of the central depressed area 6321 of the rear end wall 610 of the socket 600.

Figure 12:
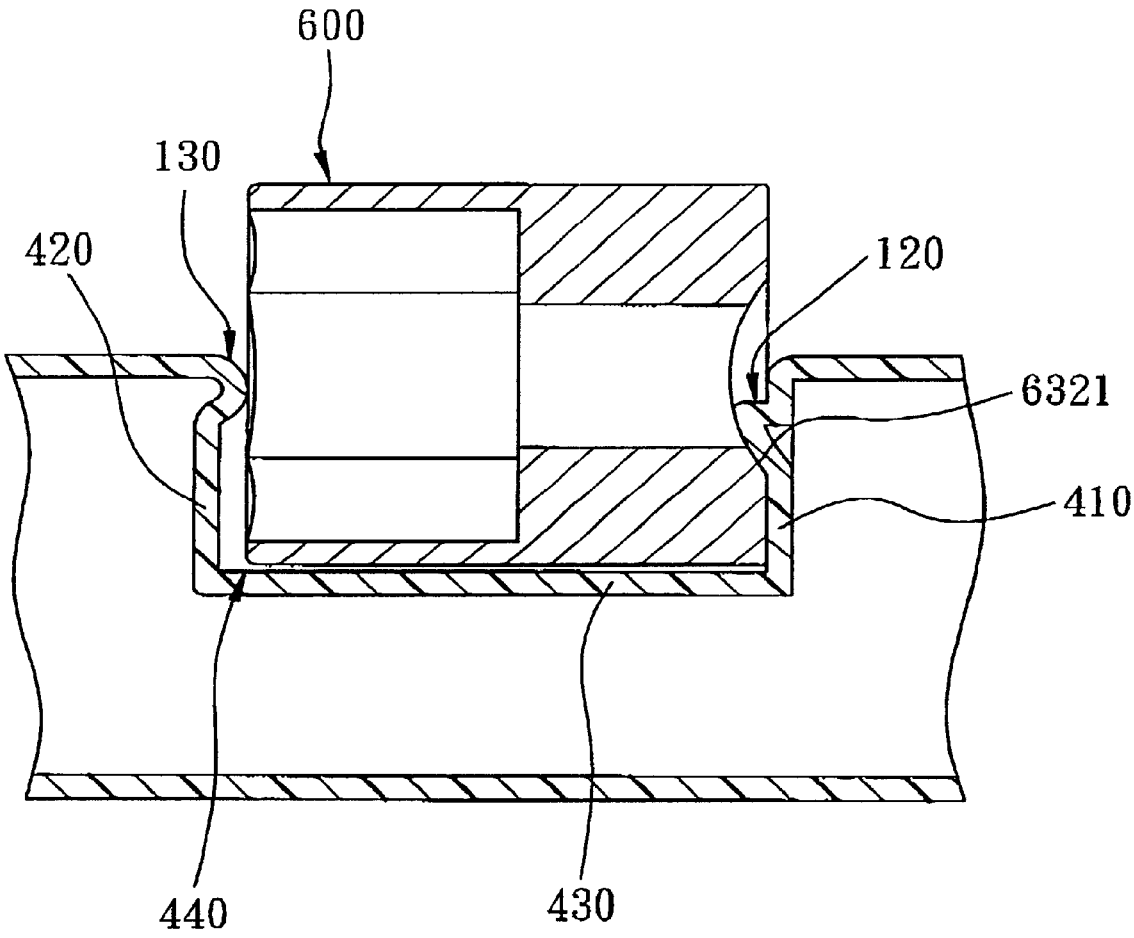
FIG. 12 is a fragmentary schematic sectional view of the sixth preferred embodiment of a tool storage unit according to the present invention, with the socket disposed in the stored position.

With reference to FIG. 12, the sixth preferred embodiment of a tool storage unit according to the present invention is shown to include left and right walls 420, 410, a bottom wall 430, and left and right protrusions 130, 120. The left and right walls 420, 410 cooperate with the bottom wall 430 to confine a socket-storing space 440. In this embodiment, the left protrusion 130 has a configuration identical to those of the left protrusions 50, 90 in the second and fourth preferred embodiments, whereas the right protrusion 120 has a configuration identical to that of the right protrusion 100 in the fifth preferred embodiment.

Figure 13:
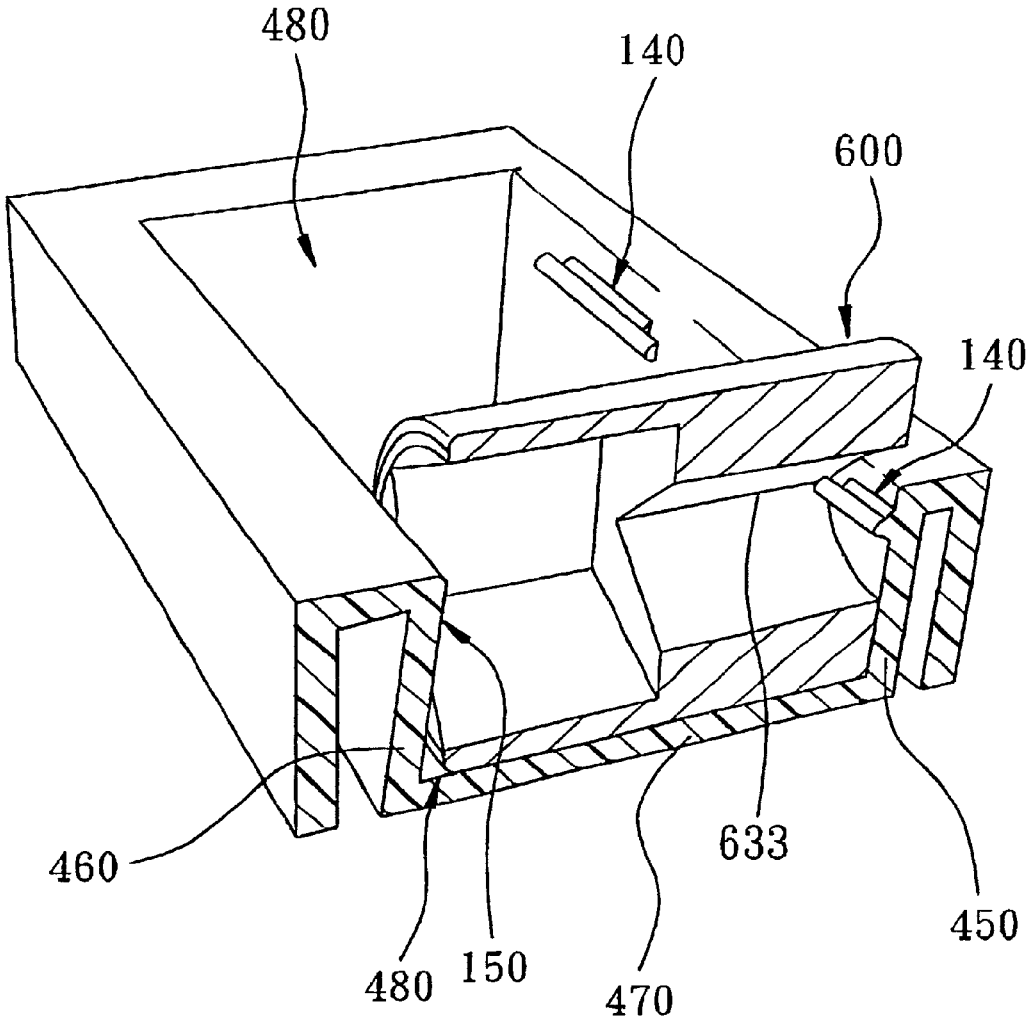
FIG. 13 is a fragmentary perspective cutaway view of the seventh preferred embodiment of a tool storage unit according to the present invention, with the socket disposed in the stored position.

With reference to FIGS. 13 and 14, the seventh preferred embodiment of a tool storage unit according to the present invention is shown to include left and right walls 460, 450, a bottom wall 470, and left and right protrusions 150, 140. The left and right walls 460, 450 cooperate with the bottom wall 470 to confine a socket-storing space 480. In this embodiment, the left protrusion 150 has a configuration identical to those of the left protrusions 20, 70, 110 in the first, third and fifth preferred embodiments. This embodiment differs from the previous embodiments in that the right protrusion 140 is in the form of a protruding rib that has a length corresponding to the distance between two diagonally opposite ends of the peripheral wall defining the insert hole 633 such that, when the socket 600 is in the stored position, two ends of the right protrusion 140 abut respectively against the diagonally opposite ends of the peripheral wall of the insert hole 633, as best shown in FIG. 14.

Figure 15:
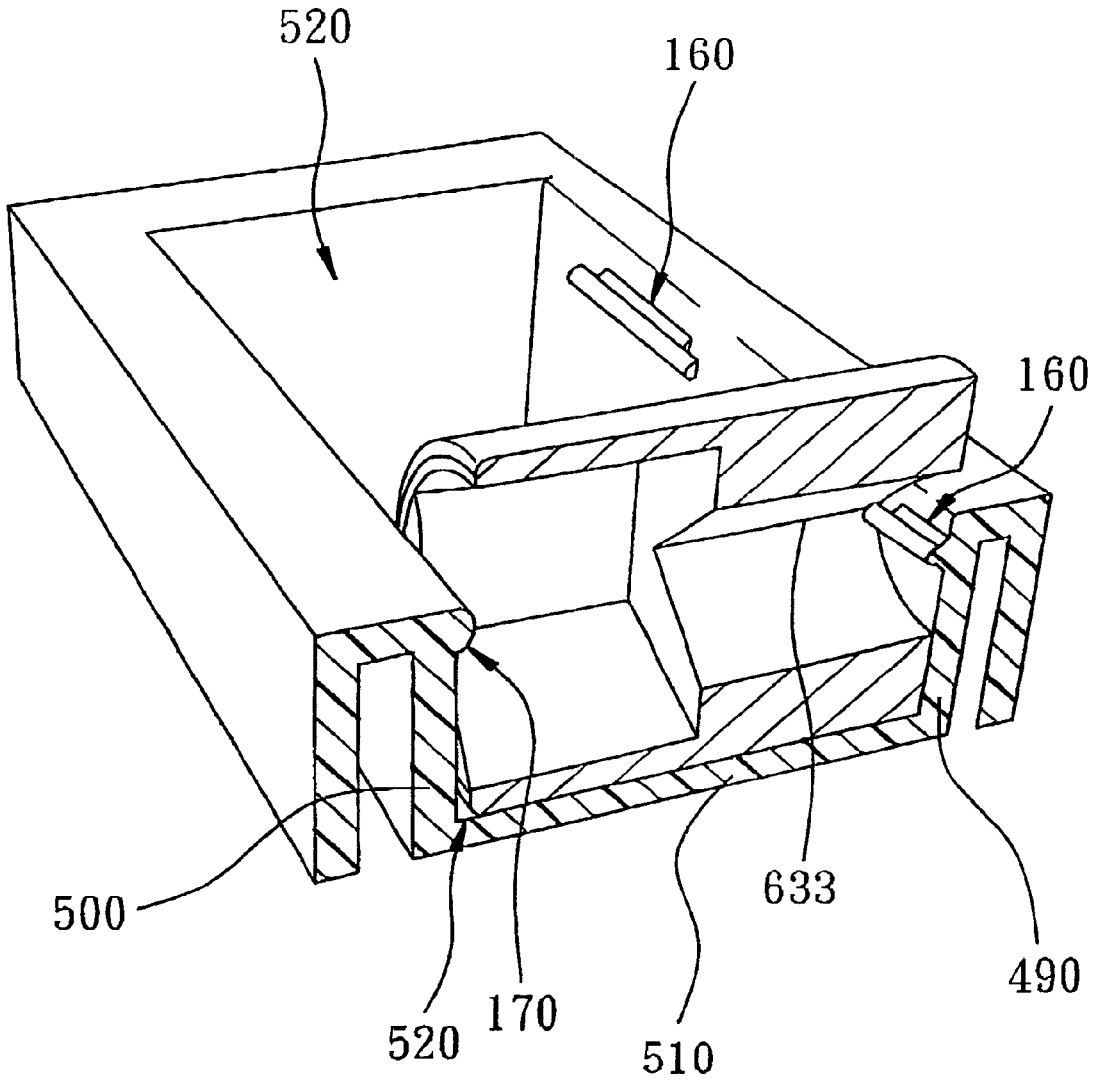
FIG. 15 is a fragmentary perspective cutaway view of the eighth preferred embodiment of a tool storage unit according to the present invention, with the socket disposed in the stored position.

With reference to FIG. 15, the eighth preferred embodiment of a tool storage unit according to the present invention is shown to include left and right walls 500, 490, a bottom wall 510, and left and right protrusions 170, 160. The left and right walls 50O, 490 cooperate with the bottom wall 510 to confine a socket-storing space 520. This embodiment is substantially similar to the seventh preferred embodiment. The difference therebetween resides in that the left protrusion 170 is in the form of a rib bulging toward the right wall 490, as in the second, fourth and sixth preferred embodiments.

Figure 16:
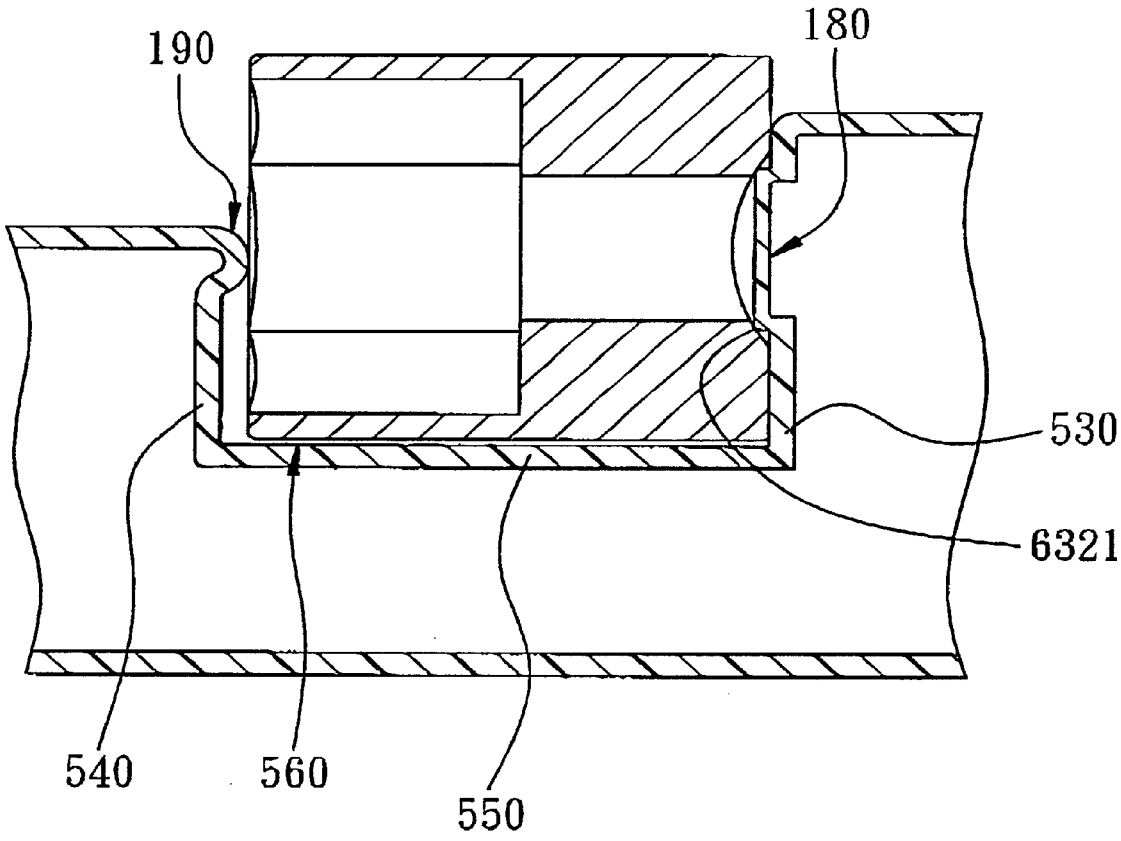
FIG. 16 is a fragmentary schematic sectional view of the ninth preferred embodiment of a tool storage unit according to the present invention, with the socket disposed in the stored position.

With reference to FIG. 16, the ninth preferred embodiment of a tool storage unit according to the present invention is shown to include left and right walls 540, 530, a bottom wall 550, and left and right protrusions 190, 180. The left and right walls 540, 530 cooperate with the bottom wall 550 to confine a socket-storing space 560. This embodiment is substantially similar to the sixth preferred embodiment. The difference therebetween resides in that the right protrusion 180 is in the form of a small flat disk protruding from an intermediate segment of the right wall 530.

By virtue of the aforesaid construction, a number of the tool storage units can be interconnected for holding a relatively large number of sockets firmly therein to achieve the advantage of compact space.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A tool storage unit for removably and firmly securing a socket therein, the socket including front and rear end walls opposite to each other along an axis and respectively having front and rear peripheries, and a tubular wall which extends along the axis to interconnect the front and rear peripheries, the front end wall having a socket recess extending inwardly and along the axis for engaging a nut, the rear end wall having a central depressed area which extends toward the front end wall and which extends inwardly and radially from a circumferential line that is disposed inwardly and radially of the rear periphery, the central depressed area having an insert hole which extends toward the front end wall, which is configured to engage a drive head of a socket wrench, and which borders the central depressed area by an inner peripheral line, the central depressed area defining a lower limit line that is the shortest one of chords of the circumferential line, and that intersects only two points of the inner peripheral line, said tool storage unit comprising:

a bottom wall having first and second ends opposite to each other in a longitudinal direction;

first and second walls which extend from said first and second ends respectively in an upright direction, each of said first and second walls including lower and upper segments proximate to and distal from said bottom wall, and a middle segment interposed therebetween, the socket being placed in said tool storage unit in a stored position, where the tubular wall has a lower part close to said bottom wall, the rear end wall confronts said second wall, and the axis is oriented in the longitudinal direction;

a first protrusion which projects from said upper segment of said first wall toward said second wall and which extends in a transverse direction that is transverse to both the longitudinal direction and the upright direction; and a second protrusion which protrudes from said middle segment of said second wall toward said first wall, which extends in the transverse direction, and which has a first length along the transverse direction that is not shorter than said lower limit line, such that, when the socket is placed in said tool storage unit in the stored position, said first protrusion abuts against two points on the front periphery of the front end wall and said second protrusion abuts against the central depressed area.

2. The tool storage unit of claim 1, wherein said second protrusion is in the form of a dome-shaped boss that abuts against the central depressed area.

3. The tool storage unit of claim 1, wherein said second protrusion is in the form of a dome-shaped boss that extends into the insert hole.

4. The tool storage unit of claim 1, wherein said first wall inclines gradually towards said second wall, said first protrusion having an inclined plane oriented toward said second wall.

* * * * *